United States Patent [19]

Yano

[11] Patent Number: 4,927,325

[45] Date of Patent: May 22, 1990

[54] VARIABLE-DISPLACEMENT TURBINE

[75] Inventor: Shunji Yano, Tokyo, Japan

[73] Assignee: Honda Giken Kogyo Kabushiki Kaisha, Tokyo, Japan

[21] Appl. No.: 338,984

[22] Filed: Apr. 14, 1989

[30] Foreign Application Priority Data

Apr. 15, 1988 [JP] Japan ..... 63-94073

[51] Int. Cl.[5] ..... F01D 17/14

[52] U.S. Cl. ..... 415/161; 415/163

[58] Field of Search ..... 415/148, 150, 151, 160, 415/161, 163, 164, 165, 159, 162

[56] References Cited

U.S. PATENT DOCUMENTS

| | | | |
|---|---|---|---|
| 4,153,385 | 5/1979 | Riefenthaler | 415/148 |
| 4,729,715 | 3/1988 | Wilde | 415/150 |
| 4,780,054 | 10/1988 | Yano et al. | 415/164 |
| 4,820,118 | 4/1989 | Yano et al. | 415/164 |

FOREIGN PATENT DOCUMENTS

| | | | |
|---|---|---|---|
| 127459 | 9/1928 | Switzerland | 415/164 |

OTHER PUBLICATIONS

European patent No. 248,624, Dec. 1987, Inventor: Inoue et al.

*Primary Examiner*—Carl D. Price
*Assistant Examiner*—John T. Kwon
*Attorney, Agent, or Firm*—Lyon & Lyon

[57] ABSTRACT

A variable-displacement turbine includes a turbine wheel disposed in a housing, a scroll passage defined in the housing around the turbine wheel, at least one fixed vane and at least one movable vane disposed between the scroll passage and said turbine wheel and arranged alternately in the direction of rotation of the turbine wheel, the fixed and movable vanes jointly defining a variable nozzle which has an opening adjustable in response to angular movement of the movable vane. At least one of the fixed vane and the movable vane has a bypass passage defined therein in bypassing relation to the variable nozzle.

9 Claims, 3 Drawing Sheets

VARIABLE-DISPLACEMENT TURBINE

BACKGROUND OF THE INVENTION

1. Field of the Invention

The present invention relates to a variable-displacement turbine, and more particularly to a variable-displacement turbine for use in a turbocharger for an internal combustion engine.

2. Description of the Relevant Art

As disclosed in Japanese Laid-Open Patent Publication No. 62-282122, the variable-displacement turbine of a turbocharger for an automotive internal combustion engine includes variable nozzles disposed in an exhaust passage for guiding exhaust gases to a turbine wheel. The opening of the variable nozzles is adjusted according to operating conditions or the like of the internal combustion engine to control the speed of flow of the exhaust gases which impinge upon the turbine wheel. More specifically, the variable-displacement turbine includes a turbine housing defining a scroll passage which opens toward the outer periphery of the turbine wheel for guiding the exhaust gases to swirl and impinge upon the turbine wheel. The scroll passage houses therein an array of alternate stationary and movable vanes extending radially outwardly of the turbine wheel, the stationary and movable vanes jointly defining the variable nozzles between their confronting surfaces.

The opening of the variable nozzles can be adjusted by tilting the movable vanes. A wall of the scroll passage has engaging portions such a steps for engaging the movable vanes to limit the angular displacement of the movable vanes thereby establishing a minimum opening of the variable nozzles. The steps are shaped in complementary relation to the configuration of the movable vanes.

The variable-displacement turbine disclosed in the above publication increases the controllability of the turbocharger since it provides a larger range of variable openings of the variable nozzles.

However, the disclosed variable-displacement turbine must be machined with high precision because the vane-shaped steps for establishing the minimum opening for the variable nozzles need to be machined highly precisely. As a result, the process of manufacturing the variable-displacement turbine is complex and highly costly. The publication referred to above also shows an embodiment which has two stationary vanes and two movable vanes. With such fewer movable vanes, however, nozzles or ports for supplying exhaust gases from the scroll to the turbine wheel are largely spaced from each other, a configuration which may adversely affect the efficiency of the turbine.

SUMMARY OF THE INVENTION

It is an object of the present invention to provide a variable-displacement turbine which can supply a sufficient amount of exhaust gases to a turbine wheel for higher turbine efficiency irrespective of the number of movable vanes used and even when the angle at which the movable vanes are tilted is small.

To achieve the above object, there is provided in accordance with the present invention a variable-displacement turbine comprising: a housing; a turbine wheel disposed in the housing; a scroll passage defined in the housing around the turbine wheel; at least one fixed vane and at least one movable vane disposed between the scroll passage and the turbine wheel and arranged alternately as an annular array in the direction of rotation of the turbine wheel; and a variable nozzle jointly defined by the vanes and having an opening adjustable in response to angular movement of the movable vane; at least one of the fixed vane and the movable vane having a bypass passage defined therein in bypassing relation to the variable nozzle.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
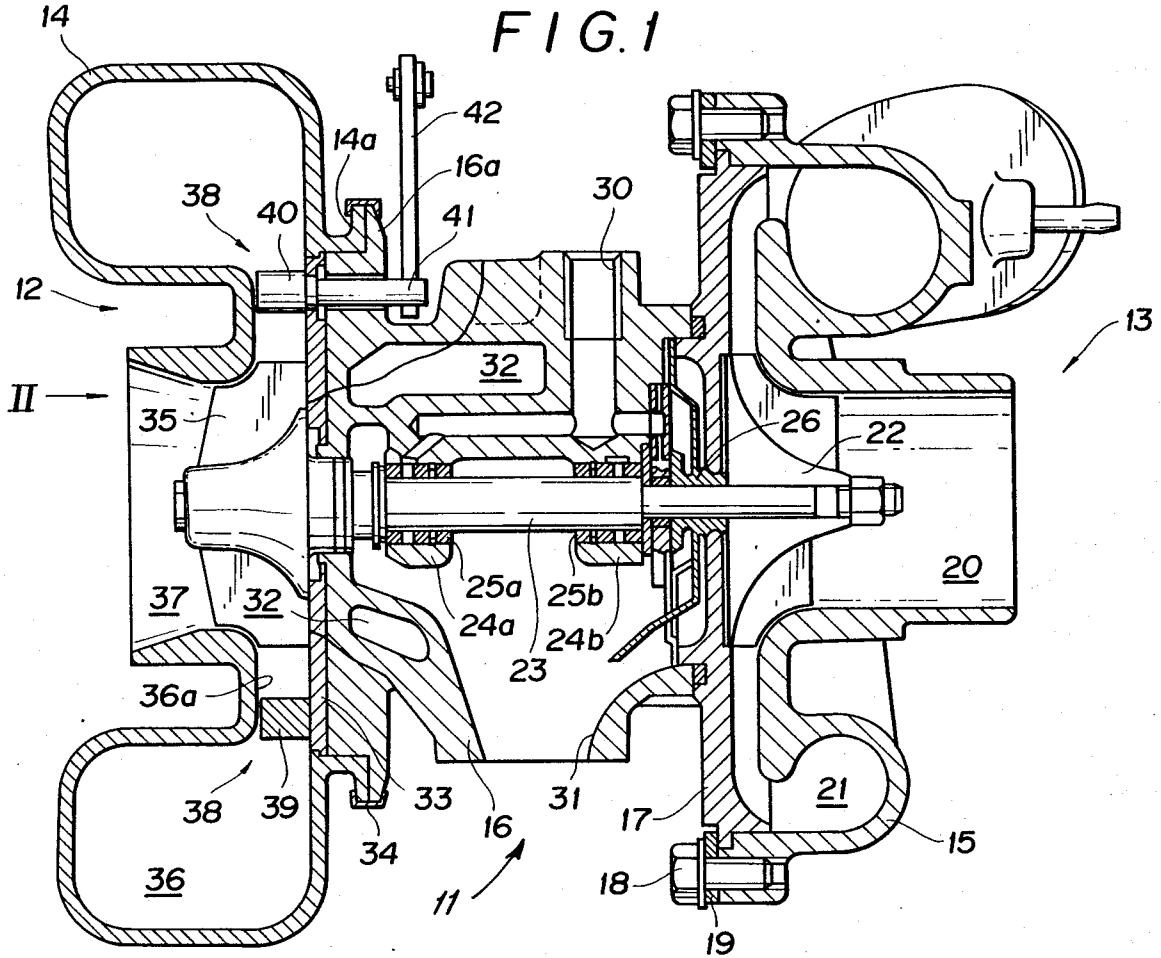
FIG. 1 is an axial cross-sectional view of a turbocharger incorporating a variabe-displacement turbine according to a first embodiment of the present invention.
Figure 2:
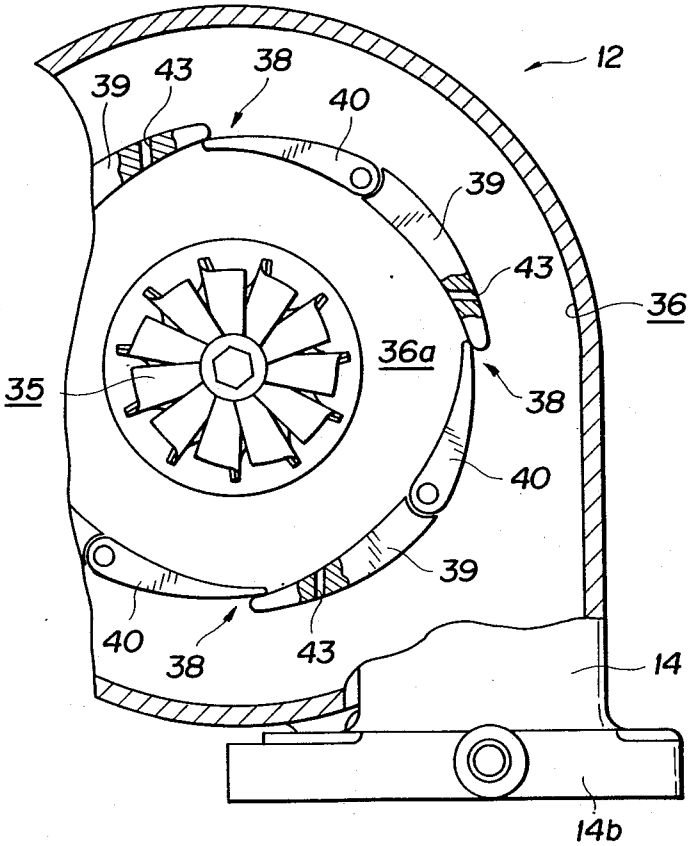
FIG. 2 is a fragmentary view as viewed in the direction indicated by the arrow II in FIG. 1.

As shown in FIGS. 1 and 2, a variable-displacement turbine 12 according to a first embodiment of the present invention is incorporated in a turbocharger 11 having a compressor 13. The turbocharger 11 comprises a turbine housing 14 accommodating the variable-displacement turbine 12 therein and a compressor housing 15 accommodating the compressor 13 therein. The turbine housing 14 and the compressor housing 15 are securely coupled to each other through a central housing 16 disposed therebetween. The compressor housing 15 defines therein a substantially cylindrical axial passage 20 and a scroll passage 21 extending around the passage 20. A back plate 17 is fixed by bolts 18 and an attachment plate 19 to the end of an opening in the compressor housing 15 near the central housing 16, thus closing the opening in the compressor housing 15. The back plate 17 is also fastened to the central housing 16 by means of bolts or the like (not shown). Therefore, the compressor housing 15 is fixed to the central housing 16 through the back plate 17. In FIG. 1, the axial passage 20 in the compressor housing 15 has an open righthand end connected to an air cleaner or the like (not shown). The outer periphery of the scroll passage 21 has an air outlet communicating with a carburetor or the like (not shown). The lefthand end of the axial passage 20 communicates with the inner peripheral end of the scroll passage 21 at a region where a rotatable compressor impeller 22 is housed. The compressor impeller 22 is coupled to the righthand end (as shown) of a shaft 23 rotatably supported centrally in the central housing 16. As described later on, the shaft 23 can be rotated about its own axis by a turbine wheel 35 coupled to the lefthand end of the shaft 23. Therefore, the turbine wheel 35, the shaft 23, and the turbine impeller 22 are rotatable in unison with each other. The shaft 23 serves as the output shaft of the turbine 12.

The central housing 16 has two bearing holders 24a, 24b disposed therein. The shaft 23 is rotatably supported by bearings 25a, 25b mounted respectively in the bearing holders 24a, 24b, the bearings 25a, 25b being rotatable with respect to the shaft 23 and the bearing holders 24a, 24b. The bearing holders 24a, 24b and the bearing holders 25a, 25b constitute a floating bearing assembly.

The shaft 23 has a smaller-diameter portion projecting axially to the right (FIG. 1) beyond the righthand bearing holder 24b. The smaller-diameter portion of the shaft 23 extends axially through a bushing 26 fitted in a central opening defined in the back plate 17 and into the axial passage 20 in which the compressor impeller 22 is coupled to the smaller-diameter portion of the shaft 23. The central housing 16 has oil supply and discharge passages 30, 31 defined respectively upwardly and downwardly of the bearing holders 24a, 24b, and also has a water jacket 32 defined around the bearing holder 24a near the turbine housing 14. The oil supply passage 30 has an upper open end communicating with an oil pump (not shown) and a lower end branched into communication with the floating bearing assembly 24a, 24b, 25a, 25b. The oil discharge passage 31 has a lower opening communicating with a reservoir tank or the like (not shown). Lubricating oil is supplied through the oil supply passage 30 to the floating bearing assembly 24a, 24b, 25a, 25b to lubricate and cool the same. Thereafter, the lubricating oil flows through the oil discharge passage 31 and is recovered by the reservoir tank. The water jacket 32 has a lower water inlet port and an upper water outlet port (both not shown). A cooling medium is supplied to the lower water inlet port by means of a water pump (not shown), and, after having cooled the central housing 16, the cooling medium is discharged from the upper water outlet port into a water tank (not shown). The central housing 16 is cooled by the cooling medium flowing through the water jacket 32 to reduce an adverse effect caused as upon heat soak back.

The turbine housing 14 has an opening defined in a righthand (FIG. 1) wall thereof in which the lefthand end of the central housing 16 is fitted. A base plate 33 which closes the opening of the turbine housing 14 is clamped between the outer edge of the opening and the lefthand end of the central housing 16. The outer periphery of the opening of the turbine housing 14 and the outer periphery of the lefthand end of the central housing 16 have respective attachment flanges 14a, 16a with their outer peripheral edges fastened to each other by means of a clamp plate 34, thus connecting the turbine housing 14 and the central housing 16 firmly to each other.

The shaft 23 has a lefthand end projecting through the base plate 33 into the turbine housing 14 and supporting the turbine wheel 35 which is axially immovably splined to the projecting end of the shaft 23, the turbine wheel 35 having a number of blades. The turbine housing 14 defines therein a spiral scroll passage 36 and a substantially cylindrical axial passage 37 extending centrally through the scroll passage 36. The wheel 35 is disposed in the axial passage 37 which has a lefthand end communicating with a muffler or the like (not shown). The turbine housing 14 also has an exhaust inlet 14b opening tangentially to the scroll passage 36 and coupled to an engine (not shown) for supplying exhaust gases emitted from the engine into the scroll passage 36. The scroll passage 36 and the axial passage 37 are radially joined to each other through a transition space serving as a restricted throat 36a in which variable nozzles 38 are defined. Exhaust gases supplied to the scroll passage 36 are delivered as swirling flows through the variable nozzles 38 and bypass passages 43 (described later) to the turbine wheel 35 to rotate the turbine wheel 35. After having rotated the turbine wheel 35, the exhaust gases are discharged through the outlet passage 37 into the muffler.

FIG. 2 shows the turbocharger 12 as viewed in the direction indicated by the arrow II in FIG. 1, but the turbine housing 14 is omitted from illustration. To the base plate 33, there are alternately attached fixed vanes 39 and movable vanes 40 which are jointly arrayed in a circular pattern concentric with the turbine wheel 35. Each of the fixed vanes 39 is of a substantially wing shape which is progressively sharper from the proximal end to the distal end thereof, and is welded or otherwise firmly fixed to the base plate 33 so as to extend circumferentially. Each of the movable vanes 40 is also of a substantially wing shape and has a proximal end fixed to an inner end of a rotatable shaft 41 rotatably extending through the base plate 33 so that the movable vane 40 extends circumferentially. Links 42 coupled to an actuator (not shown) are connected to the outer ends of the rotatable shafts 41 which are positioned near the central housing 16. When the shafts 41 are rotated by the actuator through the links 42, the movable vanes 40 are radially angularly moved with the shafts 41 about the axes of these shafts 41. Each of the variable nozzles 38 is defined between the radially inner surface of the distal end of one of the fixed vanes 39 and the radially outer surface of the distal end of an adjacent one of the movable vanes 40. Each fixed vane 39 has a substantially radial bypass passage 43 defined therethrough and having a radially inner open end near the turbine wheel 35 which is inclined at a prescribed angle with respect to the center of rotation of the turbine wheel 35. The bypass passages 43 are positioned in bypassing relation to the respective variable nozzles 38 for allowing the exhaust gases to flow from the scroll passage 36 through the bypass passages 43 toward the turbine wheel 35 at all times.

The turbocharger 11 operates as follows: Dependent on operating conditions of the engine, the actuator actuates the links 42 to angularly adjust the movable vanes 40 to adjust the opening of the variable nozzles 38. As shown in FIG. 2, the variable nozzles 38 are fully closed when the distal ends of the movable vanes 40 are held against the respective distal ends of the fixed vanes 39. Even with the variable nozzles 38 fully closed, however, the scroll passage 36 is kept in communication with the space around the turbine wheel 35 through the bypass passages 43. Therefore, the bypass passages 43 provides a minimum opening through which the scroll passage 36 communicates with the space around the turbine wheel 35.

Exhaust gases introduced from the exhaust inlet 14b into the scroll passage 36 in the variable-displacement turbine 12 are ejected through the bypass passages 43 toward the center of rotation of the turbine wheel 35 at a prescribed angle. If the variable nozzles 38 in the throats 36a are opened even slightly, then the exhaust gases in the scroll passage 36 are also ejected through the variable nozzles 38 toward the turbine wheel 35 while being restricted by the variable nozzles 38. Under this condition, the exhaust gases ejected through the variable nozzles 38 and the bypass passages 43 are applied to the turbine wheel 35 in an appropriate direction to rotate the turbine wheel 35. As the turbine wheel 35 rotates, the shaft 23 and the compressor impeller 22 are rotated in unison to enable the compressor 13 to compress air.

As described above, the bypass passages 43 are defined in the respective fixed vanes 39 in bypassing relation to the variable nozzles 38 for establishing a minimum opening through which the scroll passage 36 communicates with the space around the turbine wheel 35. Therefore, a sufficient amount of exhaust gases is allowed to flow through the bypass passages 43 and impinge upon the turbine wheel 35 at a certain angle irrespective of the angle of inclination of the movable vanes 40. As a result, regardless of the angular position of the turbine wheel 35 and the angle of inclination of the movable vanes 40, the energy of the applied exhaust gases is effectively converted into rotational energy of the turbine wheel 35, thus achieving high turbine efficiency. The bypass passages 43 can be provided without increasing the number of the movable vanes 40 and the number of the fixed vanes 39. If necessary, a plurality of bypass passages may be defined in each of the fixed vanes 39, and bypass passages may be defined in the respective movable vanes 40. Consequently, the variable-displacement turbine 12 is simple in structure and can be manufactured at a low cost.

The scroll passage 36 is given a minimum opening for communication with the space around the turbine wheel 35 without forming steps or the like on a wall surface of the scroll passage 36 for stopping the movable vanes 40. The bypass passages 43 can be defined by a relatively simple process, but the outer profiles of the vanes 39, 40 which jointly define the variable nozzles 38 therebetween do not require a high degree of accuracy. Accordingly, the variable-displacement turbine 12 can be manufactured according to a simple process. The bypass passages 43 are highly durable because they are independent from the movable vanes 40.

Figure 3:
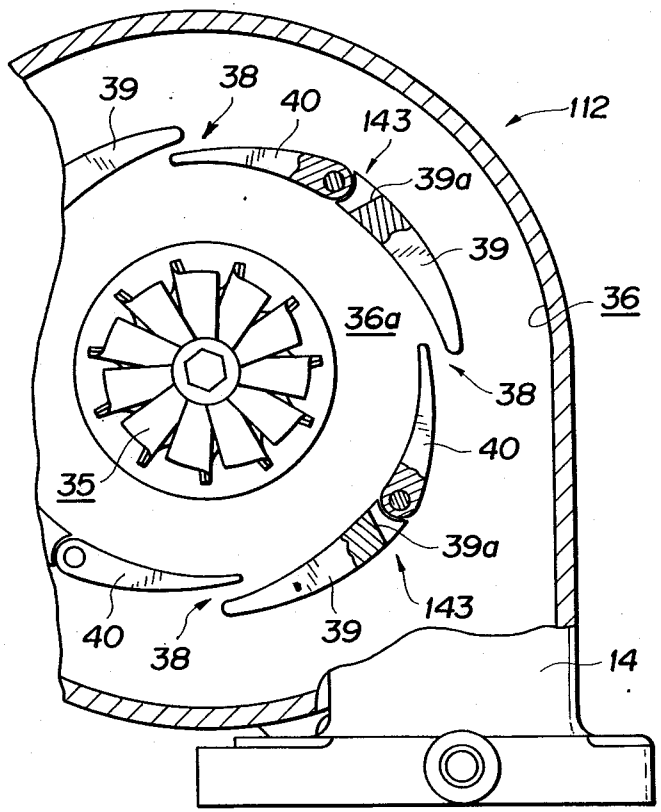
FIG. 3 is a view similar to FIG. 2, showing a variable-displacement turbine according to a second embodiment of the present invention.

FIG. 3 illustrates a variable-displacement turbine, generally designated by the reference numeral 112, in accordance with a second embodiment of the present invention. The variable-displacement turbine 112 shown in FIG. 3 is viewed in the same direction as the variable-displacement turbine 12 of FIG. 2 is viewed Those parts of FIG. 3 which are identical to those of the variable-displacement turbine 12 are denoted by identical reference numerals, and will not be described below in detail.

As shown in FIG. 3, each of the fixed vanes 39 has a recess **39*a* defined in the proximal end thereof. A surface of each fixed vane 39 which defines the recess 39*a* and a confronting surface of the proximal end of an adjacent movable vane 40 jointly define a bypass passage 143 therebetween. The bypass passage 143 has an open end near the turbine wheel 35 which is inclined at a prescribed angle to the center of rotation of the turbine wheel 35. The bypass passages 143 are positioned in bypassing relation to the respective variable nozzles 38 for allowing exhaust gases to flow from the scroll passage 36 through the bypass passages 143 toward the center of rotation of the turbine wheel 35** at a certain angle.

In the variable-displacement turbine 112, a wall surface of the scroll passage 36 has steps (not shown) for establishing a minimum angle of limitation of the movable vanes 40 to provide a minimum opening for the variable nozzles 38. That is, the minimum value of the opening of the variable nozzles 38 is set to a predetermined angle, as shown in FIG. 3. Therefore, even when the opening of the variable nozzles 38 is minimum, exhaust gases in the scroll passage 36 can flow through the bypass passages 143 and also the variable nozzles 38 toward the turbine wheel 35.

Since the recesses **39*a* which provide the bypass passages 143 can easily be defined in the fixed vanes 39, the variable-displacement turbine 112 offers the same advantages as those of the variabe-displacement turbine 12 shown in FIGS. 1 and 2. When the variable nozzles 38 are opened to their minimum level, the exhaust gases in the scroll passage 36 are ejected through the bypass passages 143 and the variable nozzles 38 toward the turbine wheel 35. Therefore, even with the minimum opening of the variable nozzles 38**, high turbine efficiency is achieved, and the engine is sufficiently supercharged when the engine is operated in a low speed range.

Figure 4:
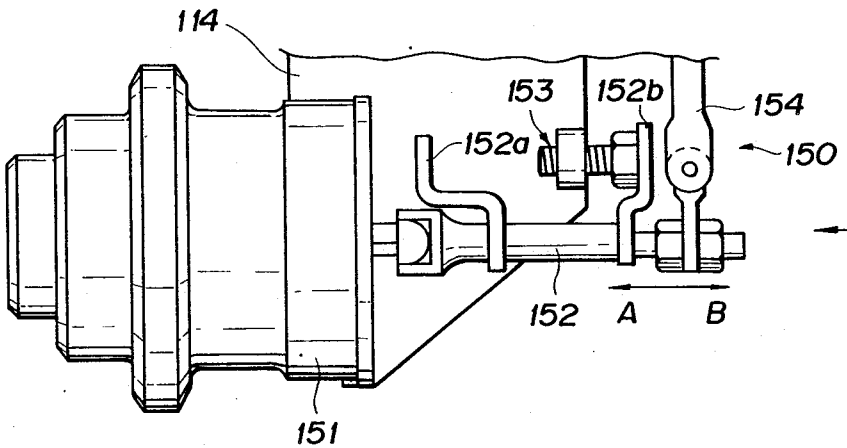
FIG. 4 is a view of a mechanism for establishing a minimum angle for variabe nozzles in the variable-displacement turbine shown in FIG. 3.

FIG. 4 shows a mechanism 150 for establishing a minimum angle for the variable nozzles 38 shown in FIG. 3, the mechanism being used instead of the steps (not shown) formed on the wall surface of the scroll passage 36.

The mechanism 150 comprises engaging members **152*a*, 152*b* fixed to a drive rod 152 of an actuator 151 mounted on a turbine housing 114, and an adjustable bolt 153 attached as a stopper to the turbine housing 114. The actuator 151 is operated dependent on operating conditions of an internal combustion engine for moving the drive rod 152 in the directions indicated by the arrows A, B. The rod 152 has a distal end coupled to the rotatable shafts of the movable vanes 40 (not shown in FIG. 4) through a transmission mechanism (not shown) including links 154. When the drive rod 152 is moved in the direction indicated by the arrow A, the link mechanism turns the movable vanes 40 in a closing direction. When the drive rod 152 is moved in the direction indicated by the arrow B, the link mechanism turns the movable vanes 40 in an opening direction. The engaging members 152*a*, 152*b* can engage the respective opposite ends of the stopper 153 to establish maximum and minimum openings for the movable vanes 40. In FIG. 4, the engaging member 152*a* is shown as engaging one of the opposite ends of the stopper 153 to open the movable vanes 40 (not shown in FIG. 4**) to a minimum.

Figure 5:
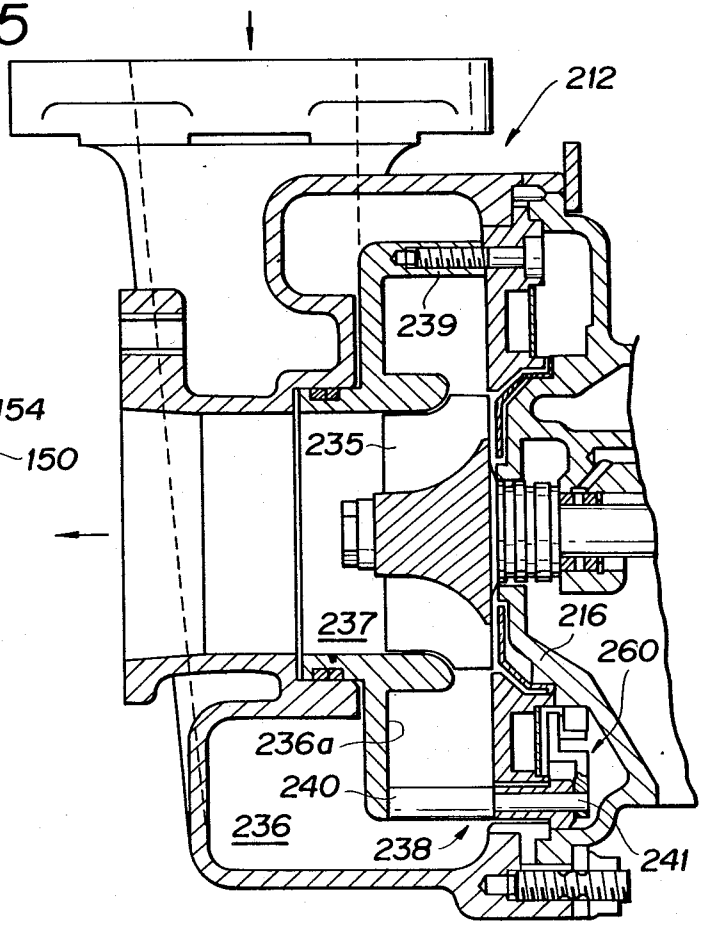
FIG. 5 is a fragmentary cross-sectional view of a variable-displacement turbine according to a third embodiment of the present invention.

FIG. 5 shows a variable-displacement turbine 212 according to a third embodiment of the present invention. The variable-displacement turbine 212 has a turbine wheel 235 and an axial passage 237. The variable-displacement turbine 212 differs from the variable-displacement turbine 12 as to the following features:

The turbine 212 has fixed vanes 239 and movable vanes 240 which are positioned in most upstream regions in a throat **236*a* and hence are disposed substantially in a scroll passage 236. As a result, variable nozzles 238 which are jointly defined by the vanes 239, 240 are positioned in the scroll passage 236. A drive mechanism 260 for rotating rotatable shafts 241 of the movable vanes 240 are housed in a central housing 216 of a turbocharger which includes the variable-displacement turbine 212**.

Although there have been described what are at present considered to be the preferred embodiments of the present invention, it will be understood that the invention may be embodied in other specific forms without departing from the essential characteristics thereof. The present embodiments are therefore to be considered in all aspects as illustrative, and not restrictive. The scope of the invention is indicated by the appended claims rather than by the foregoing description.

I claim:

1. A variable-displacement turbine comprising:

a housing;

a turbine wheel disposed in said housing;

a scroll passage defined in said housing around said turbine wheel;

at least one fixed vane and at least one movable vane disposed between said scroll passage and said turbine wheel and arranged alternately as an annular array in the direction of rotation of said turbine wheel;

a variable nozzle jointly defined by said vanes and having an opening adjustable in response to angular movement of said movable vane; and at least one of said fixed vane and said movable vane having a bypass passage defined therein in bypassing relation to said variable nozzle.

2. A variable-displacement turbine according to claim 1, wherein said bypass passage has an open end near said turbine wheel and inclined at a predetermined angle to the center of rotation of said turbine wheel.

3. A variable-displacement turbine according to claim 1, wherein said bypass passage is defined in said fixed vane.

4. A variable-displacement turbine according to claim 1, wherein said bypass passage is defined between a surface of a recess defined in a proximal end of said fixed vane and a surface of a proximal end of said movable vane disposed adjacent to said fixed vane.

5. A variable-displacement turbine according to claim 1, wherein said variable nozzle is defined between a swingable distal end of said movable vane and a confronting end of said fixed vane.

6. A variable-displacement turbine according to 5, wherein said movable vane is angularly movable to a point where said swingable distal end of said movable vane abuts said confronting end of said fixed vane to fully close said variable nozzle, said scroll passage being open toward said turbine wheel through a minimum opening which is provided by said bypass passage when said variable nozzle is fully closed.

7. A variable-displacement turbine according to claim 5, wherein said housing has a mechanism for establishing a minimum angle of angular movement of said movable vane to provide a minimum opening for said variable nozzle, and wherein said scroll passage is held in communication with a space around said turbine wheel through said bypass passage and said variable nozzle when said variable nozzle is opened to said minimum opening.

8. A variable-displacement turbine according to claim 1, further including:

an axial passage extending centrally through said scroll passage and housing said turbine wheel therein; and a restricted throat defined as a transition space between said scroll passage and said axial passage, said variable nozzle being positioned in said throat.

9. A variable-displacement turbine according to claim 1, further including:

an axial passage extending centrally through said scroll passage and housing said turbine wheel therein;

a restricted throat defined as a transition space between said scroll passage and said axial passage; and said variable nozzle being positioned in said scroll passage upstream of said throat.

* * * * *